US009827460B2

(12) United States Patent
Staten et al.

(10) Patent No.: US 9,827,460 B2
(45) **Date of Patent: *Nov. 28, 2017**

(54) ADJUSTABLE SUPPORT FOR EXERCISE SYSTEM

(71) Applicant: Rogers Athletic Company, Inc., Clare, MI (US)

(72) Inventors: Kenneth Staten, Clare, MI (US); Kyle R. Camp, Clare, MI (US)

(73) Assignee: Rogers Athletic Company, Inc., Clare, MI (US)

( * ) Notice: Subject to any disclaimer, the term of this patent is extended or adjusted under 35 U.S.C. 154(b) by 22 days.

This patent is subject to a terminal disclaimer.

(21) Appl. No.: 14/974,617

(22) Filed: Dec. 18, 2015

(65) Prior Publication Data

US 2016/0101310 A1 Apr. 14, 2016

Related U.S. Application Data

(63) Continuation of application No. 13/874,629, filed on May 1, 2013, now Pat. No. 9,248,333.

(Continued)

(51) Int. Cl.
*A63B 21/062* (2006.01)
*A63B 21/06* (2006.01)

(Continued)

(52) U.S. Cl.
CPC ..... *A63B 21/062* (2013.01); *A63B 21/0618* (2013.01); *A63B 21/0628* (2015.10); *A63B 21/078* (2013.01); *A63B 21/0724* (2013.01); *A63B 21/0783* (2015.10); *A63B 21/16* (2013.01); *A63B 21/4035* (2015.10);

(Continued)

(58) Field of Classification Search
CPC ..... A63B 21/062; A63B 21/0615; A63B 21/0724; A63B 21/078; A63B 21/08; A63B 2021/0626; A63B 2021/0612; A63B 2021/0616; A63B 2021/0617; A63B 2021/0783; A63B 21/0783; A63B 21/0618; A63B 21/4035; A63B 21/16; A63B 23/12; A63B 23/0405; A63B 23/03558;

(Continued)

(56) References Cited

U.S. PATENT DOCUMENTS 5,116,297 A 5/1992 Stonecipher
5,954,619 A * 9/1999 Petrone ..... A63B 21/078 482/104

(Continued)

*Primary Examiner* — Loan H Thanh
*Assistant Examiner* — Megan Anderson
(74) *Attorney, Agent, or Firm* — Carlson, Gaskey & Olds, P.C.

(57) ABSTRACT

An exemplary exercise device includes, among other things, an attachment structure configured to be mounted to a support assembly, a first arm directly pivotably connected to the attachment structure, a second arm directly pivotably connected to the attachment structure, a bracket directly pivotably connected to the first arm and directly pivotably connected to the second arm, and a catch member configured for accepting a weight bar. The catch member is pivotably connected to at least one of the first arm, the second arm, or the at least one bracket such that the at least one catch member is pivotable relative to the at least one bracket.

20 Claims, 14 Drawing Sheets

Related U.S. Application Data

(60) Provisional application No. 61/640,899, filed on May 1, 2012.

(51) Int. Cl.

| | |
|---|---|
| ***A63B 23/035*** | (2006.01) |
| ***A63B 21/072*** | (2006.01) |
| ***A63B 21/078*** | (2006.01) |
| ***A63B 21/16*** | (2006.01) |
| ***A63B 21/00*** | (2006.01) |
| ***A63B 23/04*** | (2006.01) |
| *A63B 23/12* | (2006.01) |

(52) U.S. Cl.

CPC .... *A63B 23/03558* (2013.01); *A63B 23/0405* (2013.01); *A63B 23/12* (2013.01); *A63B 23/1218* (2013.01); *A63B 2023/0411* (2013.01); *A63B 2225/093* (2013.01)

(58) Field of Classification Search

CPC ..... A63B 23/1218; A63B 2023/0411; A63B 2225/093; A63B 21/0004; A63B 21/072

USPC ..... 482/98, 92, 100, 97; 248/274.1, 276.1, 248/284.1, 162.1, 440.1, 171, 166

See application file for complete search history.

(56) References Cited

U.S. PATENT DOCUMENTS

| | | | | |
|---|---|---|---|---|
| 6,770,017 | B1 | 8/2004 | Leipheimer | |
| 7,070,543 | B1 * | 7/2006 | Rindfleisch ..... | A63B 21/0615 482/104 |
| 7,753,830 | B1 | 7/2010 | Marsh et al. | |
| 2006/0100075 | A1 | 5/2006 | Harsh | |
| 2012/0244999 | A1 | 9/2012 | Taurianen | |

* cited by examiner

ADJUSTABLE SUPPORT FOR EXERCISE SYSTEM

CROSS-REFERENCE TO RELATED APPLICATIONS

This application is a continuation of U.S. patent application Ser. No. 13/874,629, which filed on 1 May 2013 and has been allowed. U.S. patent application Ser. No. 13/874,629 claims priority to U.S. Provisional Application No. 61/640,899, which was filed on 1 May 2012. U.S. patent application Ser. No. 13/874,629 and U.S. Provisional Application No. 61/640,899 are both incorporated herein by reference.

BACKGROUND

The present disclosure relates to weightlifting equipment and, more particularly, to an adjustable support for resting a weight bar.

Weightlifters perform various exercises for the purpose of developing particular muscles throughout the body. These exercises can be performed through the use of free weights, such as barbells, or with machines. Many weightlifters prefer free weights because free weights permit the lifter to perform the exercises in a natural motion while utilizing pure body leverage in performing the exercise. This facilitates isolation of particular muscle groups and simulates actual athletic sports motions. The support assembly also often operates to spot the lifter.

SUMMARY

An exemplary exercise device includes, among other things, an attachment structure configured to be mounted to a support assembly, a first arm directly pivotably connected to the attachment structure, a second arm directly pivotably connected to the attachment structure, a bracket directly pivotably connected to the first arm and directly pivotably connected to the second arm, and a catch member configured for accepting a weight bar. The catch member is pivotably connected to at least one of the first arm, the second arm, or the at least one bracket such that the at least one catch member is pivotable relative to the at least one bracket.

An exemplary method of adjusting a height of an exercise device includes, among other things, selecting a first course height of the exercise device along a structure support assembly to attach at least one attachment structure, selecting a second fine height of the exercise device by engaging an extension member, maintaining a first arm parallel to a second arm when selecting the second fine height. The first arm is directly pivotably connected to a bracket that is directly pivotably connected to the second arm. The method permits a catch member to pivot relative to the bracket during the maintaining. The catch member is configured for accepting a weight bar.

An exemplary method of positioning an exercise device according to another exemplary embodiment includes, among other things, adjusting a position of at least one catch member that receives a weight bar and, during the adjusting, pivoting a first arm and a second arm together relative to at least one attachment structure mounted to a support assembly. The first arm and the second arm are each directly connected to the at least one attachment structure. The method further includes, during the adjusting, pivoting the first arm and the second arm together relative to at least at least one bracket. The first arm and the second arm are each directly connected to the at least one bracket. The method further includes during the adjusting, pivoting the catch member relative to the bracket.

These and other features of the disclosed examples can be understood from the following description and the accompanying drawings, which can be briefly described as follows.

DETAILED DESCRIPTION

Figure 1:
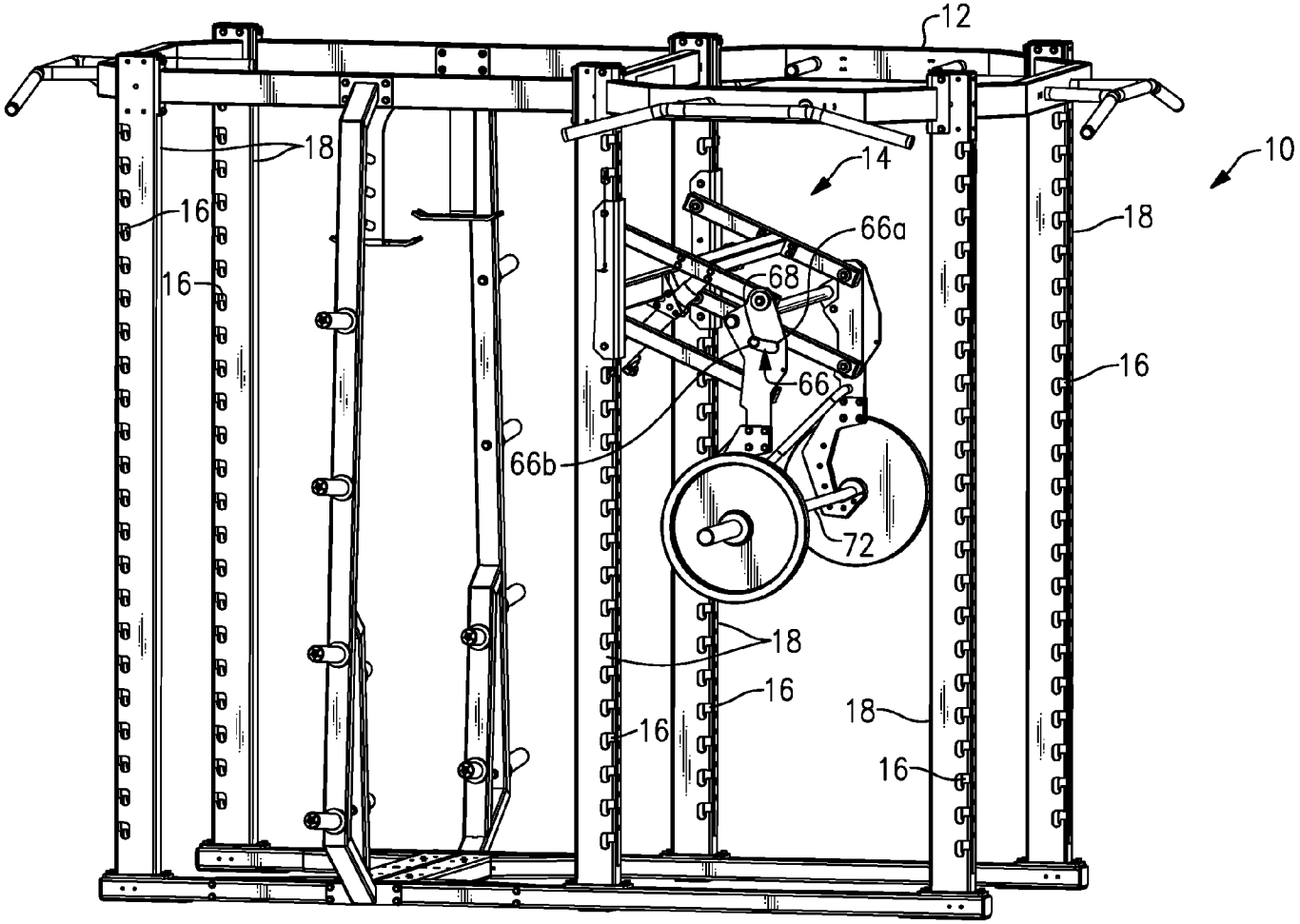
FIG. 1 is a general perspective view of an example exercise system according to an example embodiment.

FIG. 1 illustrates an example exercise system 10 including an example frame rack 12 and an example adjustable support 14. The frame rack 12 holds the adjustable support 14. It should be understood that although a particular frame rack 12 is illustrated in the example embodiment, other types of frame racks 12 could be used to hold the adjustable support 14. The adjustable support 14 is considered a monolift assembly in some examples.

Figure 14:
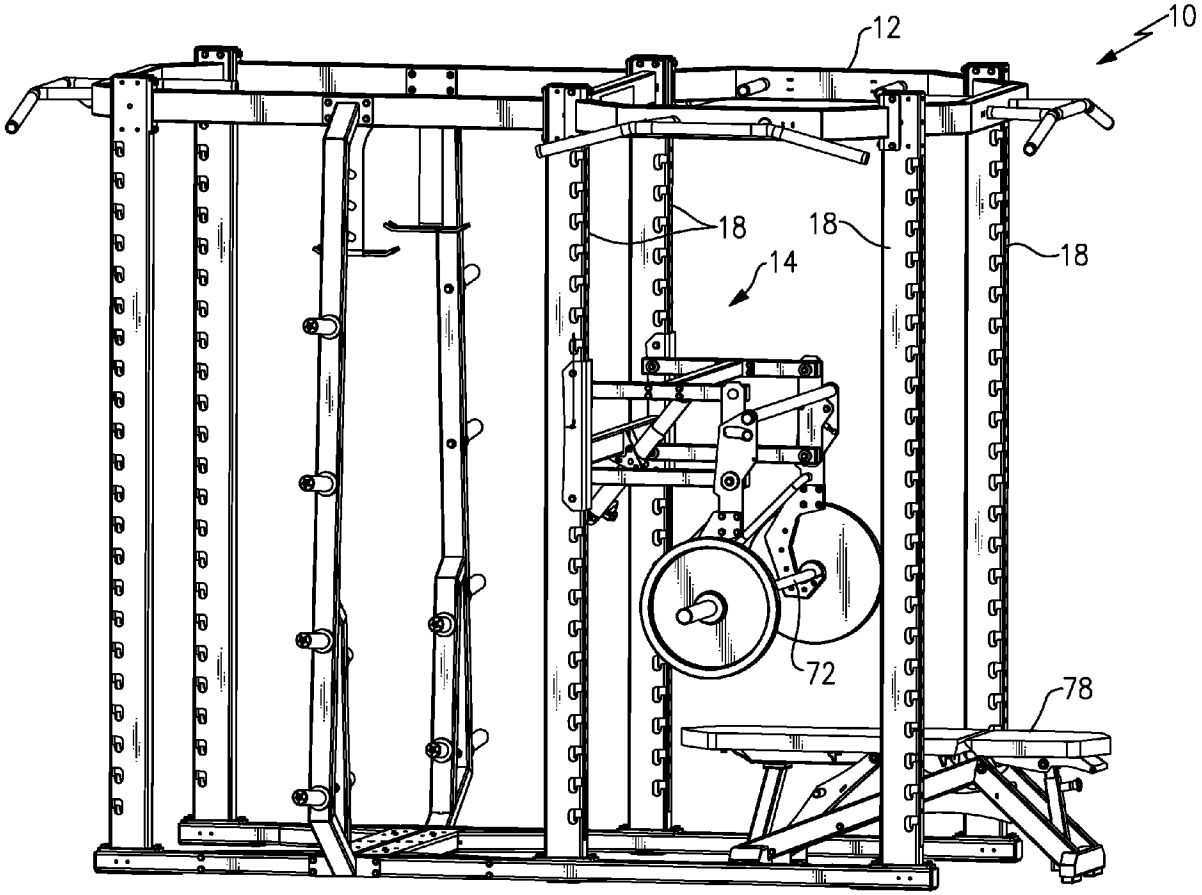
FIG. 14 is a general perspective view of the adjustable support of FIG. 8 in a bench press position.

The frame rack 12 includes multiple openings 16 that extend along upright frame members 18 to receive the adjustable support 14. The adjustable support 14 is received in selected openings so that the adjustable support 14 may be located at various vertical positions along the upright frame members 18. By allowing for multiple vertical positions, a user can utilize the adjustable support 14 for performing squats or bench presses with a bench 78 (FIG. 14) or other types of exercises. Each opening 16 is vertically separated from the next opening 16 by approximately four inches to provide significant incremental adjustment, however, any separation will be usable with the present invention.

Figure 2:
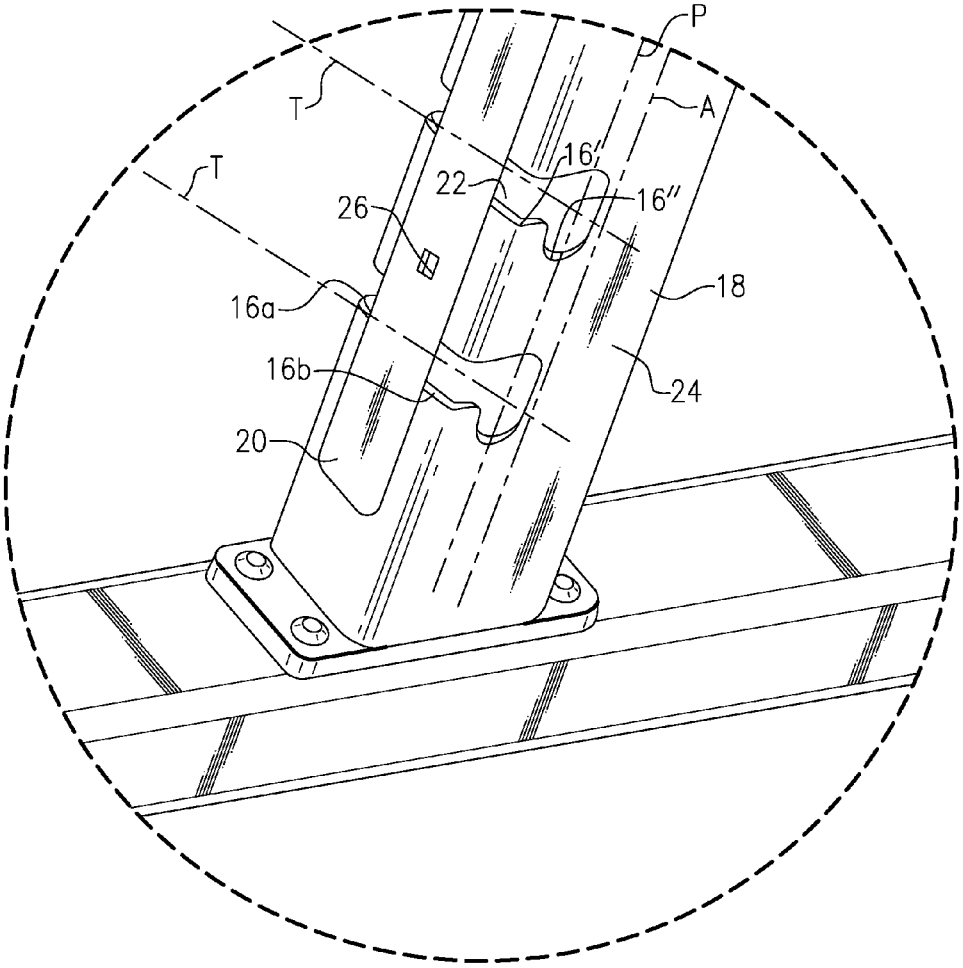
FIG. 2 is an expanded view of a weight lifting system upright frame member.

Referring to FIG. 2, each upright frame member 18 defines a longitudinal axis A extending vertically relative to the ground. The example upright frame member 18 is generally rectilinear in shape and is manufactured of tubing that is rectangular in cross-section. The upright frame member 18 has a front face 20, a first side face 22, and second side face 24. The upright frame member 18 includes multiple opposed pairs of openings 16*a*, 16*b* along the longitudinal axis A. Each of the opposed pairs of openings 16*a*, 16*b* includes a first opening 16*a* and a second opening 16*b*.

Each opening 16 is generally L-shaped and spans the intersection of the front face 20 and one of the side faces 22 and 24. In this non-limiting embodiment, the first opening 16*a* spans the front face 20 and the side face 22 and the second opening 16*b* spans the front face 20 and the side face 24. In other words, each opening 16*a*, 16*a* cuts through the corner of the upright frame member 18.

Figure 3:
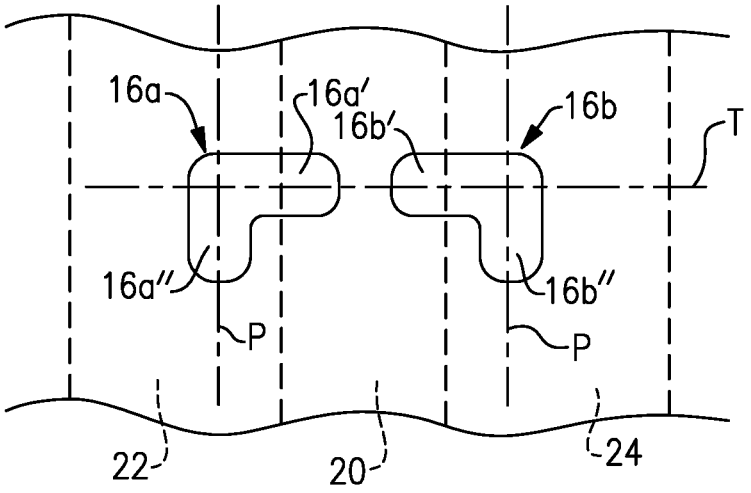
FIG. 3 is a schematic view of an opening in a weight lifting system upright frame member illustrated in FIG. 2.

Each opening 16 includes a first opening portion 16' in the front face 20 generally transverse to the longitudinal axis A along a transverse opening axis T and a second opening portion 16" through the respective side face 22 and 24 generally parallel to the longitudinal axis A along a parallel opening axis P. In this non-limiting embodiment, the first opening 16*a* defines a first opening portion 16*a*' through the front face 20 generally transverse to the longitudinal axis A along the transverse opening axis T and a second first opening portion 16*a*" through the first side face 22 generally parallel to the longitudinal axis A along the parallel axis P while the second opening 16*b* defines a first second opening portion 16*b*' through the front face 20 generally transverse to the longitudinal axis A along the transverse opening axis T and a second opening portion 16*b*" through the second side face 24 generally parallel to the longitudinal axis A along the parallel axis P. That is, the portions 16*a*', 16*b*' and 16*a*", 16*b*" are generally perpendicular and portions 16*a*' and 16*b*' are generally parallel if laid flat (FIG. 3). Preferably, each opening 16*a*, 16*b* includes relatively large corner radiuses.

The openings 16 are arranged in horizontally opposed pairs of openings 16*a*, 16*b* perpendicular to the longitudinal axis A. That is, each pair of openings 16 includes a first opening 16*a* located through the front face 20 and the first side face 22 and a second opening 16*b* located through the front face 20 and the second side face 24 such that the openings 16*a*, 16*b* are aligned when viewed from one of the side faces 22, 24.

A lock opening 26 is located through the front face 20 between each vertically separated pair of openings 16. Each lock opening 26 is displaced parallel to the longitudinal axis A and is generally square in shape. It should be understood that other shapes will also be readily usable with the example embodiment. The example lock opening 26 is longitudinally staggered above each pair of openings 16*a*, 16*b*.

Figure 4:
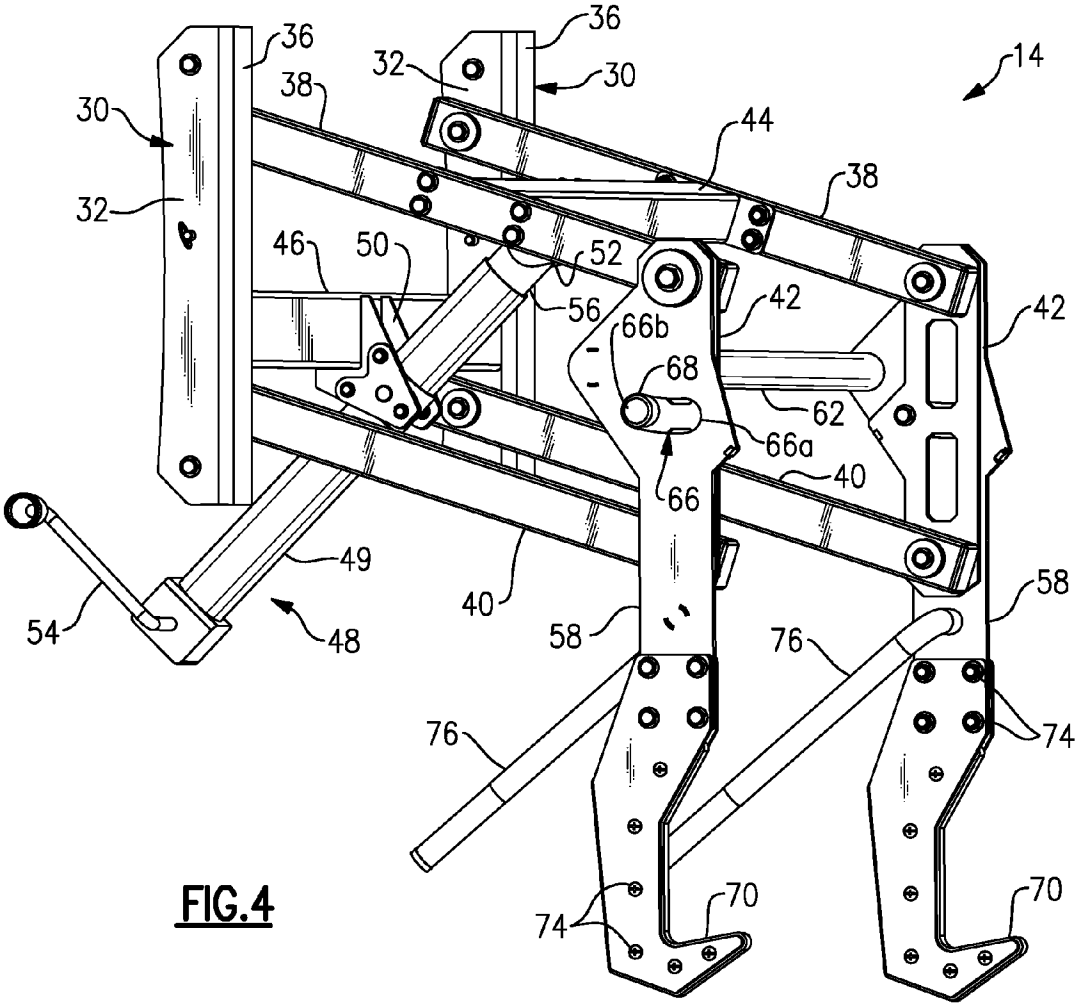
FIG. 4 is a side perspective view of an example adjustable support.
Figure 5:
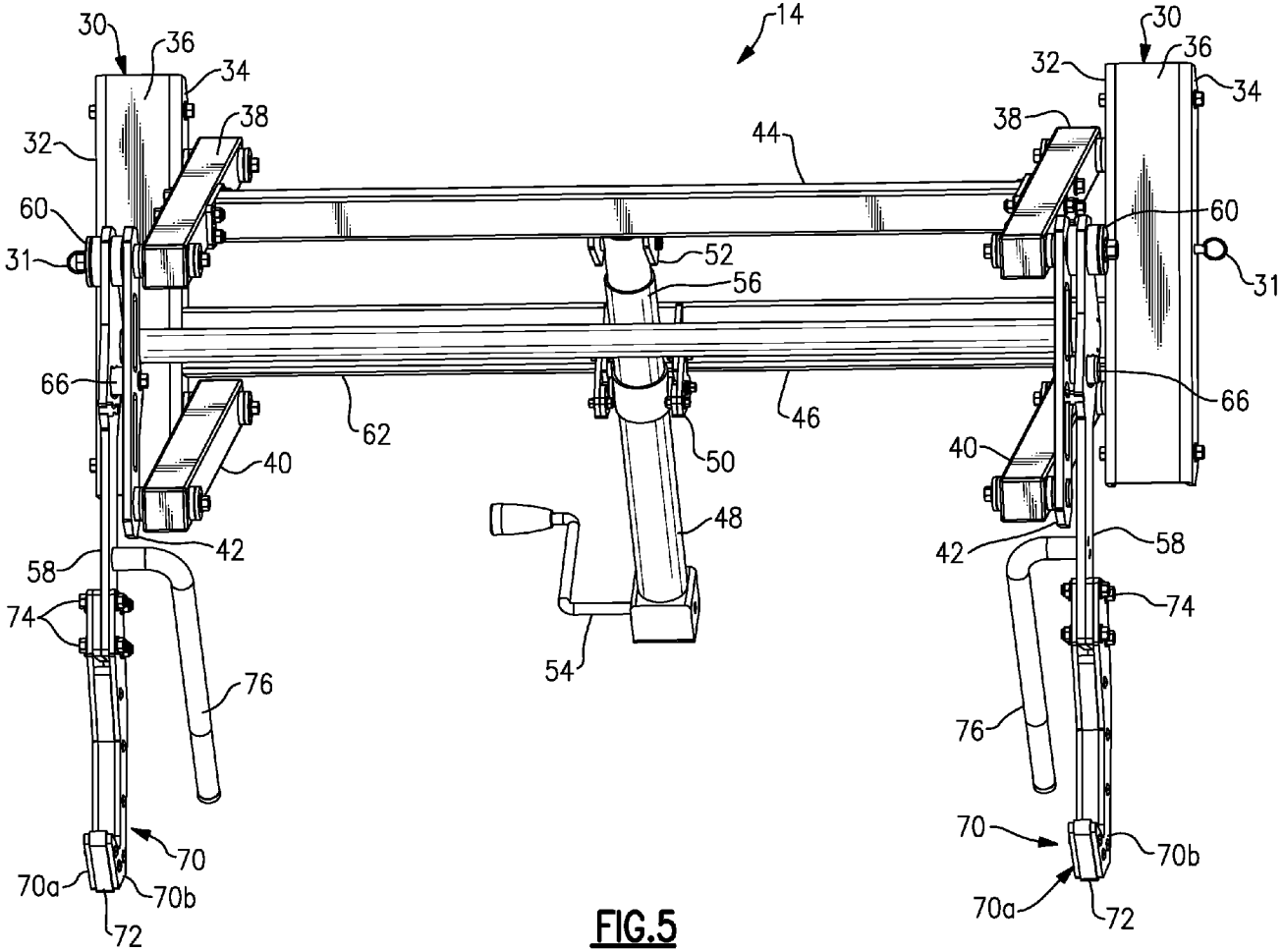
FIG. 5 is a front perspective view of the example adjustable support of FIG. 4.

Referring to FIGS. 4 and 5, the adjustable support 14 includes a pair of attachment structures 30 each having a first attachment plate 32 opposed to and generally parallel with a second attachment plate 34. The first and second attachment plates 32 and 34 extend generally perpendicularly from a central support plate 36. The first and second attachment plates 32 and 34 and the central support plate 36 have a general U-shaped cross section. The adjustable support 14 is vertically adjustable between multiple vertical heights along the upright frame members 18.

A pair of upper arms 38 and a pair of lower arms 40 extend from, and are pivotably attached to, the pair of attachment structures 30. A pair of brackets 42 extend between, and are pivotably attached to, the distal ends of the pair of upper arms 38 and the pair of lower arms 40. The pair of attachment structures 30, the pair of upper arms 38, the pair of lower arms 40, and the pair of brackets 42 form a pair of four-bar linkages. The pair of four-bar linkages are coupled together by an upper arm connecting member 44 attached to each of the upper arms 38 and a support arm connecting member 46 attached to each of the attachment structures 30. The four-bar linkages are parallelogram linkages, which allows the pair of attachment structures 30 to remain parallel with the pair of brackets 42 and the pair of upper arms 38 to remain parallel with the pair of lower arms 40 during movement of the upper arms 38, lower arms 40, and brackets 42.

A jack 48, such as a screw jack or a hydraulic jack, varies the position of the pair of upper arms 38, the pair of lower arms 40, and the pair of brackets 42 relative to the attachment structures 30, which are attachable to the upright frame members 18. The jack 48 includes a body portion 49, which is pivotably attached to the support arm connecting member 46 by a first pivot bracket 50, and a rod member 56 having a distal end pivotably attached to a second pivot bracket 52 on the upper arm connecting member 44. The jack 48 includes a rotatable handle 54 that extends the rod member 56 to raise the upper and lower arms 38 and 40 and the pair of brackets 42 when rotated in a first direction and retracts to lower the upper and lower arms 38 and 40 and the pair of brackets 42 when rotated in a second direction opposite the first direction. The jack 48 allows for relatively fine adjustment of the adjustable support 14 to multiple lift positions, such as a squat position.

A catch member 58 is pivotably attached at each of the pivot points between the pair of upper arms 38 and the pair of brackets 42. Each catch member 58 includes an elongated arcuate slot 66 spaced from the pivot axis. Each slot 66 accepts a stopper 68, such as a rubber bushing, that is rigidly attached to each of the pair of brackets 42 for limiting the range of motion of the catch members 58 relative to the pair of brackets 42. A catch member connecting arm 62 extends between and is rigidly connected to each of the catch members 58 so that the catch members 58 move together in unison. Since the attachment structures 30, the upper and lower arms 38, 40, and the pair of brackets 42 form a parallelogram four-bar linkage, the catch members 58 will maintain essentially the same alignment relative to the pair of brackets 42 when the adjustable support 14 is being adjusted by the jack 48.

The distal end of the catch members 58 includes a hook portion 70 for engaging a weight bar 72 (FIG. 1). The hook portion 70 includes a first half 70*a* and a second half 70*b* that sandwiches a grip member 71, such as a rubber or a plastic member, to increase the hook portion's 70 ability to grip the weight bar 72. A plurality of fasteners 74 secure the first half 70*a* to the second half 70*b* and secure the hook portion 70 to the remaining portion of the catch member 58.

A spring loaded member 60 is located adjacent the pivot axis of the catch members 58 for biasing the catch members 58 toward a retracted position where the stopper 68 engages a first end 66*a* of the slot 66. The biasing force of the spring loaded members 60 is overcome when the weight bar 72 is placed on the hook portions so that the catch members 58 move to a generally vertical position where the stopper 68 engages a second end 66*b* of the slot 66 (FIG. 1).

An elongated handle 76 is attached to each of the catch members 58 for facilitating movement of the catch members 58 toward a vertical position to accept the weight bar 72 when spotting a lifter. The handles 76 are located on both of the catch members 58 to allow a spotter to move the catch members 58 from either side of the lifter during lifting.

Figure 6:
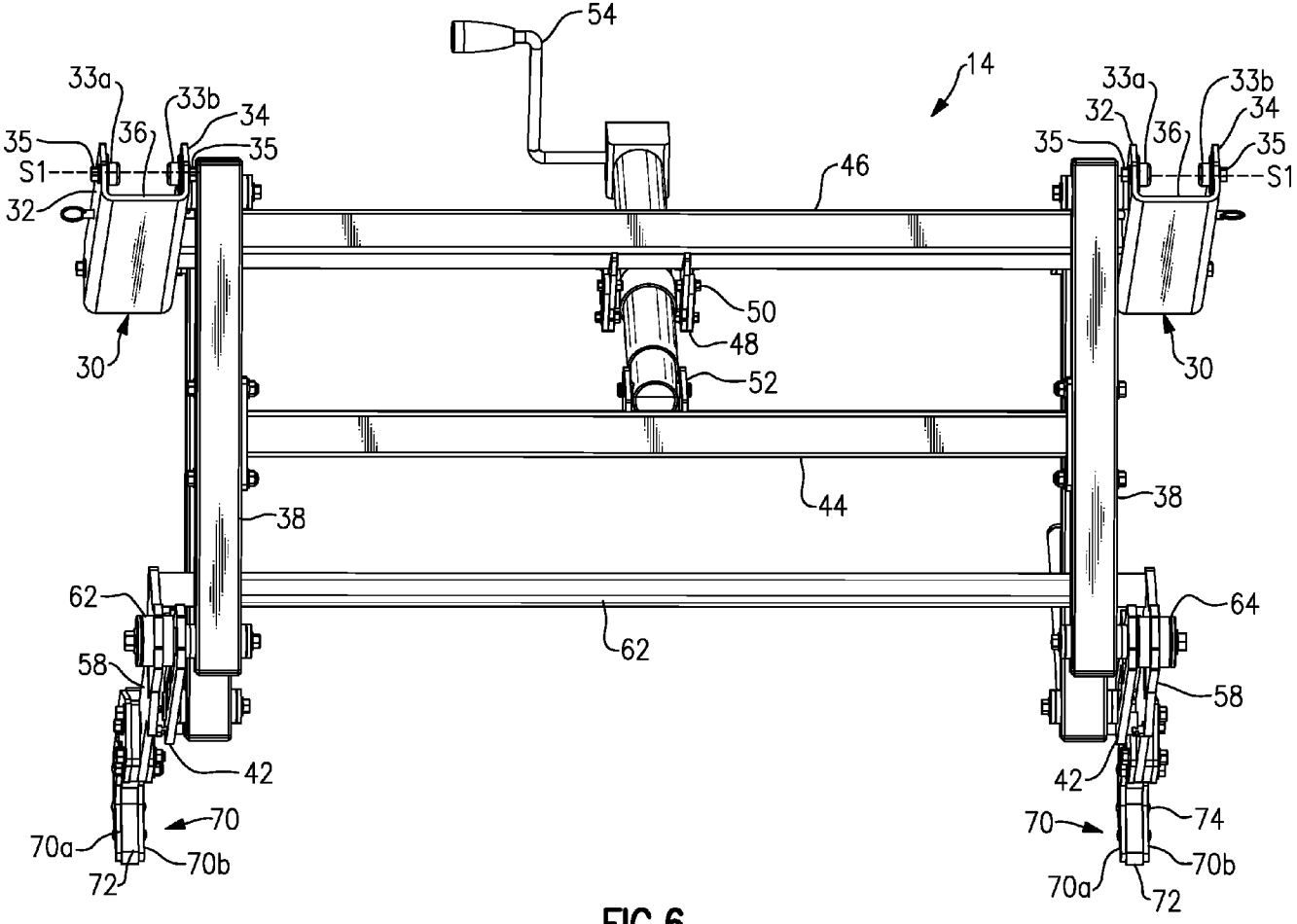
FIG. 6 is a top perspective view of the example adjustable support of FIG. 4.
Figure 7:
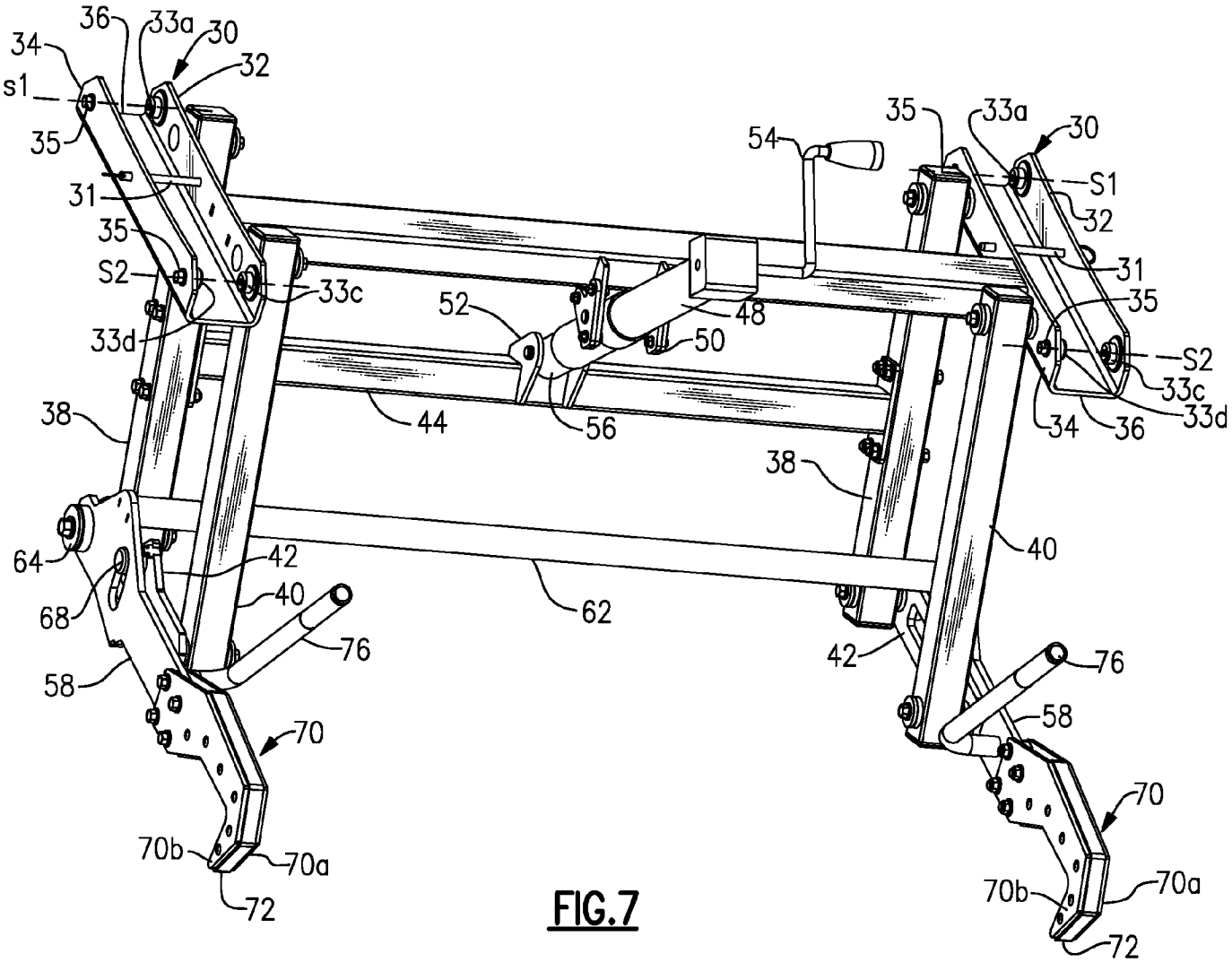
FIG. 7 is a bottom perspective view of the example adjustable support of FIG. 4.
Figure 8:
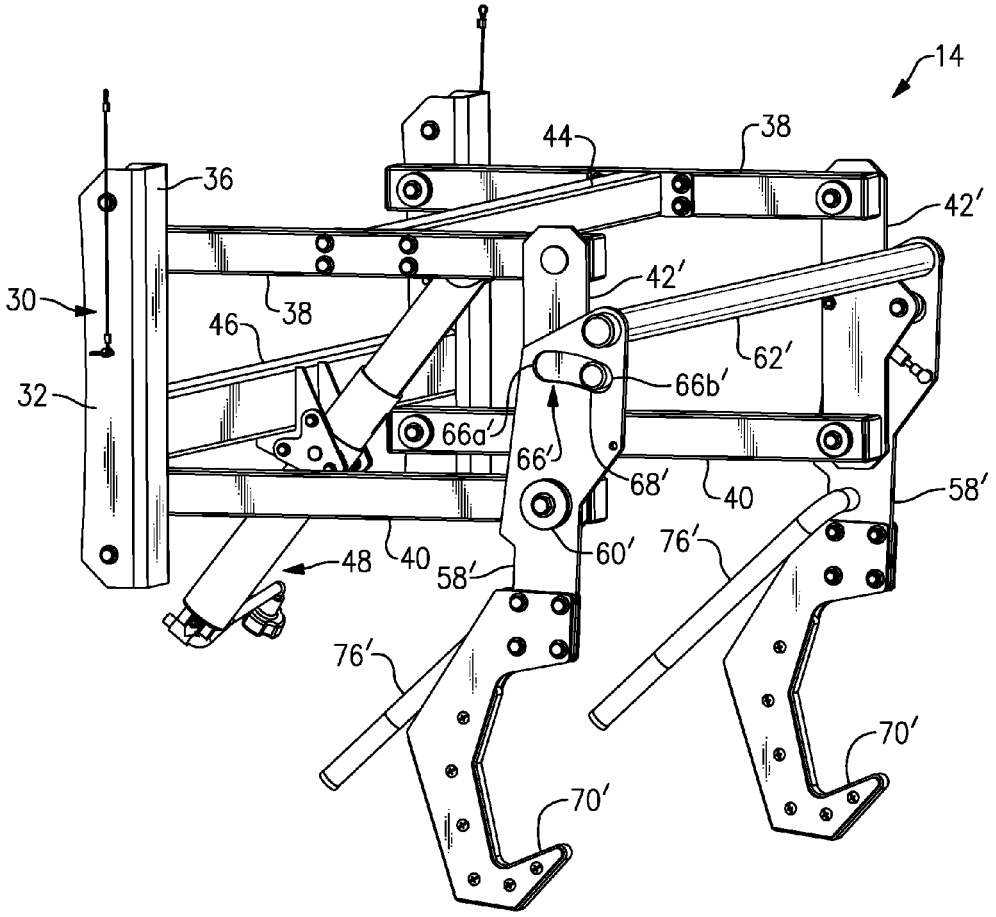
FIG. 8 is a general perspective view of the adjustable support of FIG. 4 with another example catch member and example pair of brackets.

Referring to FIGS. 6 and 7, a first, second, third, and fourth stud 33*a*-33*d* extend from an inner surface of the first and second attachment plates 32, 34 to engage the openings 16 (FIG. 2). The first stud 33*a* extends from the first attachment plate 32 and is directly opposed to the second stud 33*b* which extends from an inner surface of the second attachment plate 34. The third stud 33*c* extends from the first attachment plate 32 and is directly opposed to the fourth stud 33*d* which extends from an inner surface of the second attachment plate 34. The first and second studs 33*a*, 33*b* are located on a common axis S1 and the third and fourth studs 33*c*, 33*d* are located along a common axis S2. The studs 33*a*-33*d* are relatively significant solid members which mount through the first and second attachment plates 32, 34 with fasteners 35 or the like. A safety pin 31 extends through the first and second attachment plates 32, 34 to secure the adjustable support 14 to the upright frame members 18 by extending through the openings 16.

Figure 9:
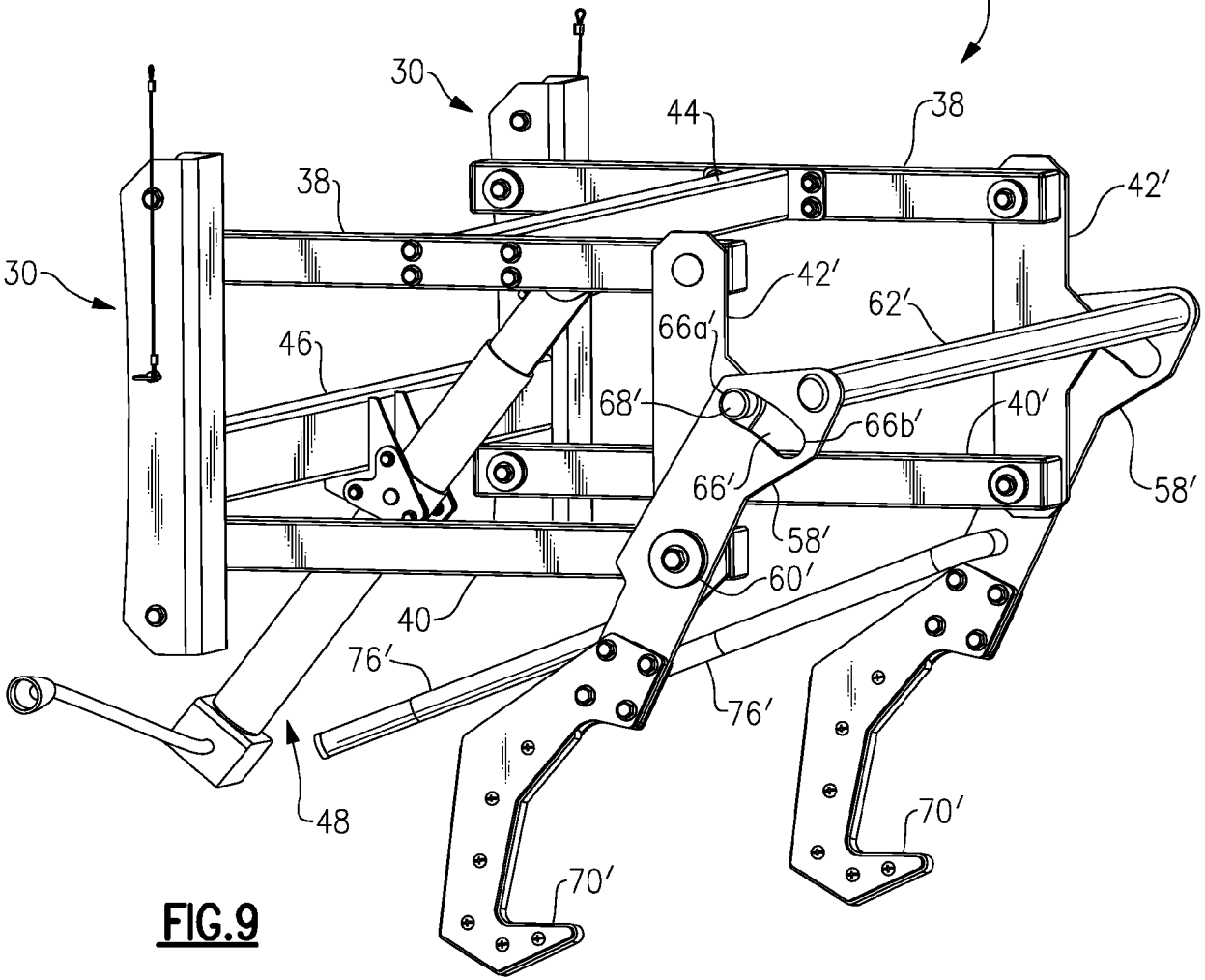
FIG. 9 is a general perspective view of the adjustable support of FIG. 8.
Figure 10:
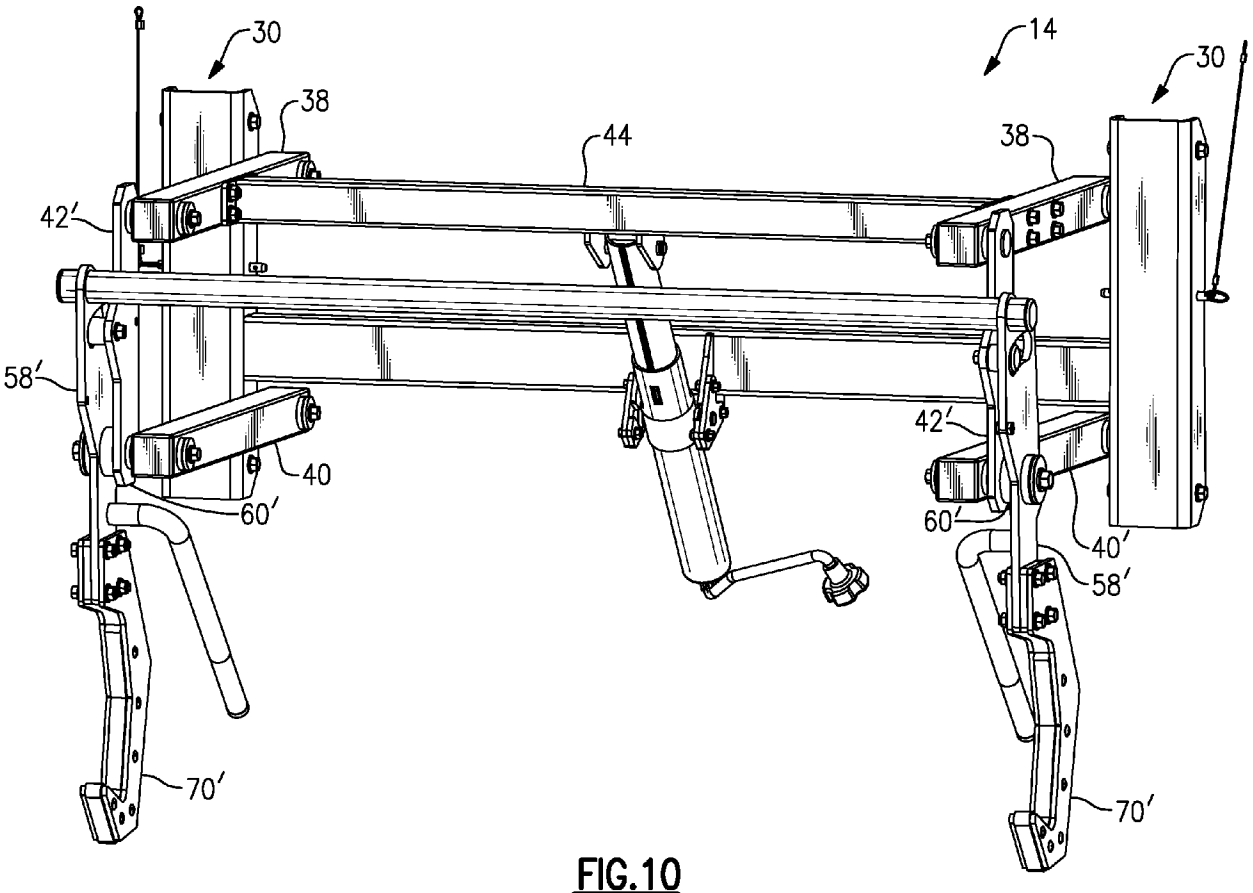
FIG. 10 is a general perspective view of the adjustable support of FIG. 8.
Figure 11:
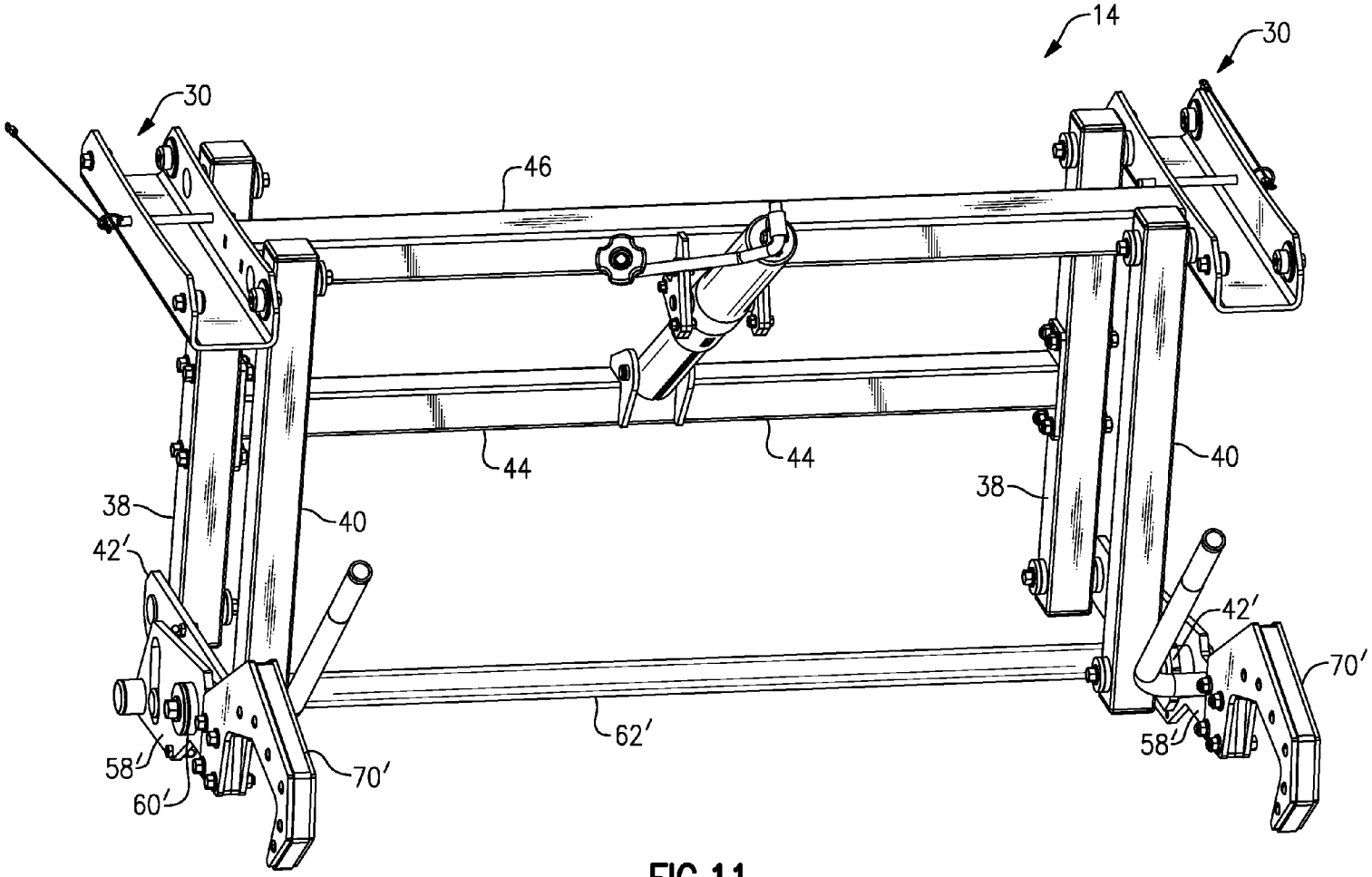
FIG. 11 is a bottom perspective view of the adjustable support of FIG. 8.
Figure 12:
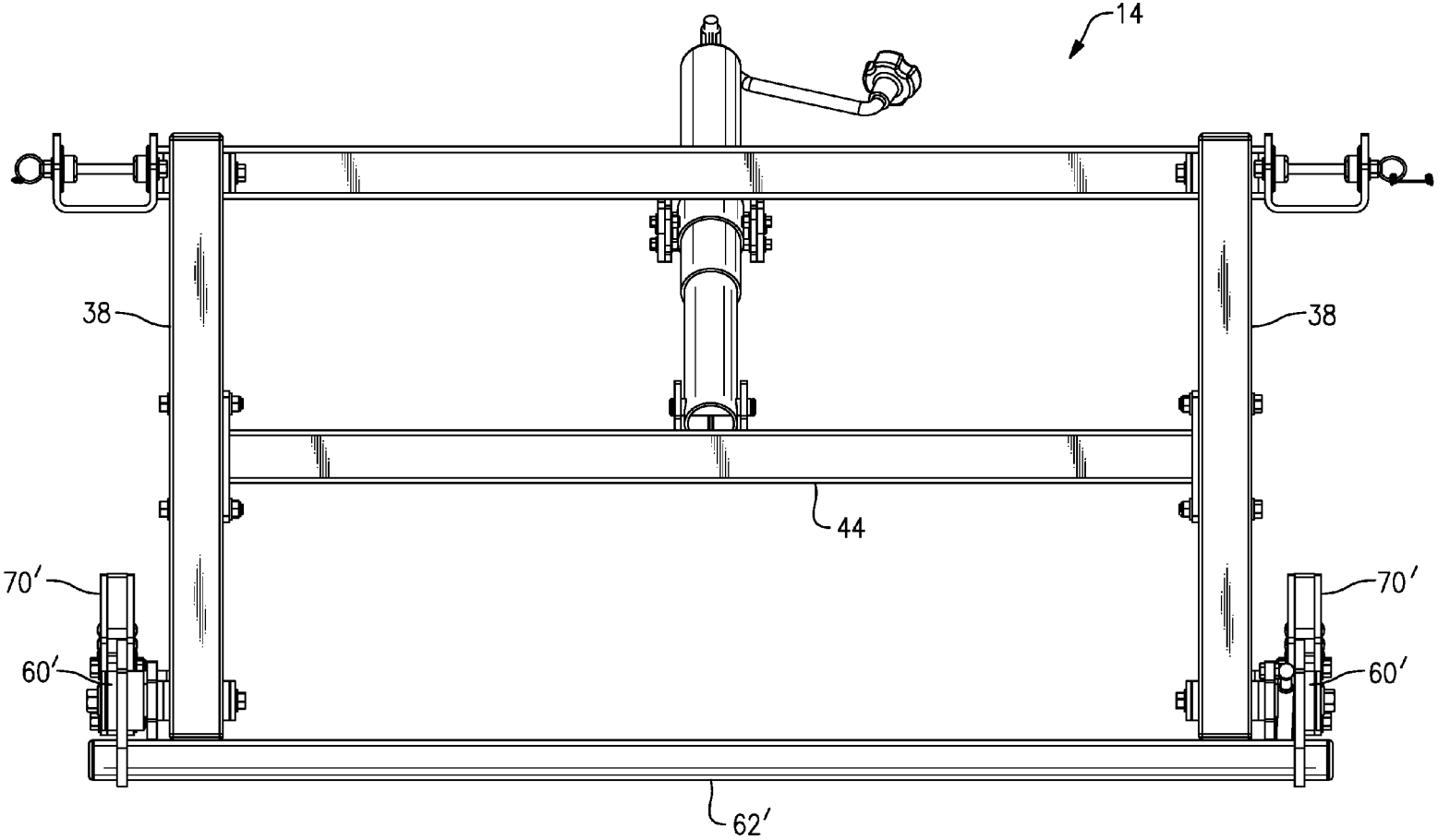
FIG. 12 is a top view of the adjustable support of FIG. 8.
Figure 13:
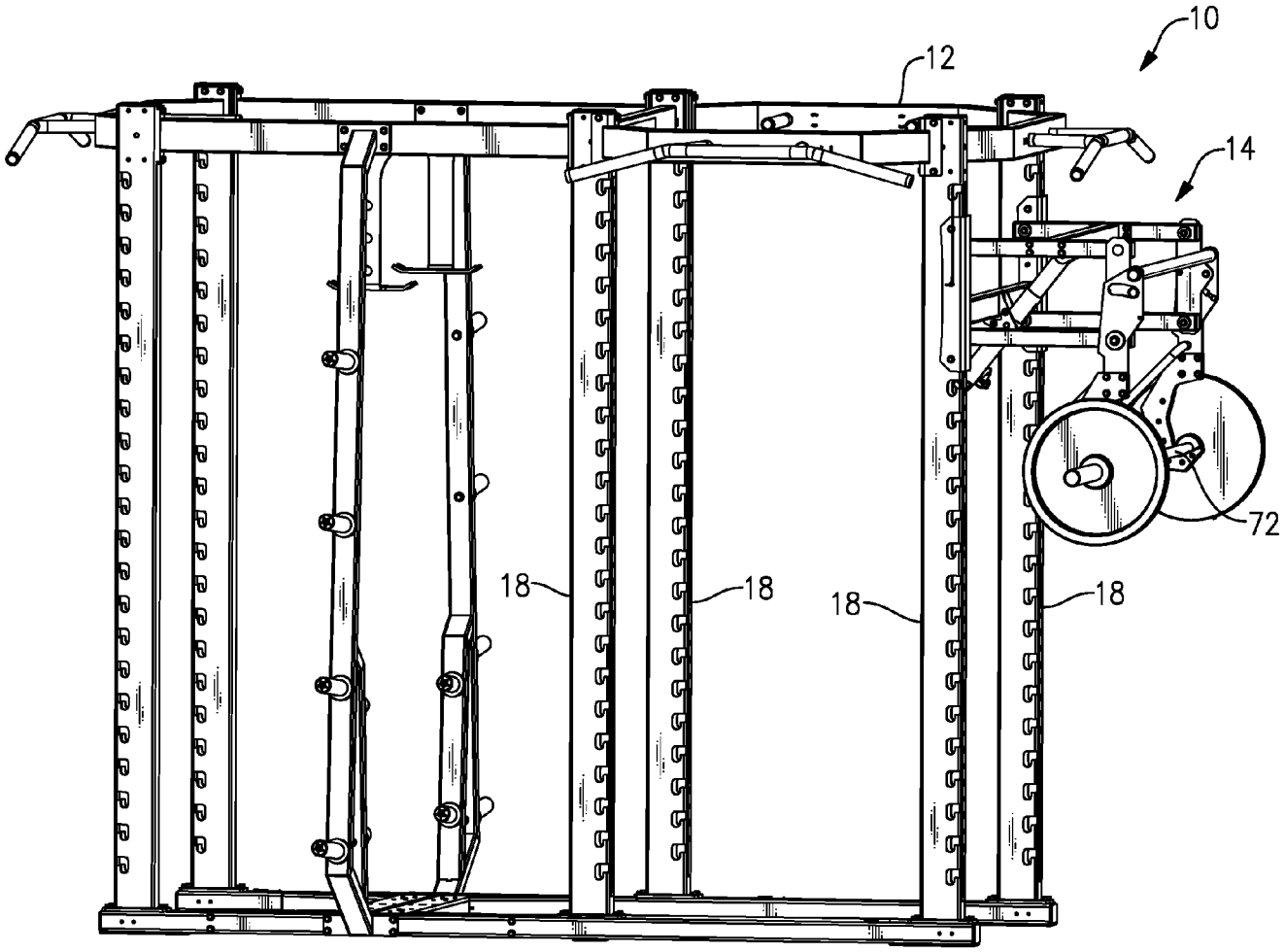
FIG. 13 is a perspective view of the example adjustable support of FIG. 8 attached to a front pair of upright frame members.

FIGS. 8-14 illustrate another example adjustable support 14' including another example pair of brackets 42', another example catch member 58', and another example catch member connecting arm 62'. A spring loaded member 60' is located adjacent the pivot axis of the catch members 58' and the lower pair of arms 40 for biasing the catch members 58' toward a retracted position where the stopper 68' engages a first end 66*a*' of the slot 66' (FIG. 9). The biasing force of the spring loaded members 60' is overcome when the weight bar 72 is placed on the hook portions 70' or when elongated handles 76' are biased outward so that the catch members 58' move to a generally vertical position where the stopper 68' engages a second end 66*b*' of the slot 66' (FIG. 9).

The example adjustable support 14' can be moved to different vertical positions as desired for squats, bench presses, etc. as the adjustable support 14.

Although an example embodiment of this disclosure has been disclosed, a worker of ordinary skill in this art would recognize that certain modifications would come within the scope of this disclosure. For that reason, the following claims should be studied to determine the true scope and content of this invention.

What is claimed is:

1. An exercise device, comprising:

at least one attachment structure configured to be mounted to a support assembly;

a first arm directly pivotably connected to the at least one attachment structure;

a second arm directly pivotably connected to the at least one attachment structure;

at least one bracket directly pivotably connected to the first arm and directly pivotably connected to the second arm; and at least one catch member configured for accepting a weight bar, the at least one catch member pivotably connected to at least one of the first arm, the second arm, or the at least one bracket such that the at least one catch member is pivotable relative to the at least one bracket.

2. The exercise device of claim 1, wherein the at least one attachment structure is parallel to the at least one bracket.

3. The exercise device of claim 2, wherein the first arm is parallel to the second arm.

4. The exercise device of claim 1, wherein the at least one catch member includes a slot or a protrusion, and the at least one bracket includes the other of the slot or the protrusion, the protrusion received within the slot to limit pivoting movement of the at least one catch member relative to the at least one bracket.

5. The exercise device of claim 4, wherein the slot is an arcuate slot.

6. The exercise device of claim 1, including an extension member configured to move the first arm relative to the at least one attachment structure.

7. The exercise device of claim 1, further comprising a spring loaded member located adjacent a pivot axis of the at least one catch member, the spring loaded member biasing the at least one catch member toward a retracted position.

8. The exercise device of claim 1, wherein the at least one attachment structure includes protrusions configured to engage openings on the support assembly.

9. The exercise device of claim 1, wherein the at least one catch member includes a hook portion on an end.

10. The exercise device of claim 1, including a handle attached to the at least one catch member.

11. An exercise assembly comprising the exercise device of claim 1, and further comprising a support frame, the exercise device attachable to the support frame.

12. A method of adjusting a height of an exercise device comprising the steps of:

selecting a first course height of the exercise device along a structure support assembly to attach at least one attachment structure;

selecting a second fine height of the exercise device by engaging an extension member;

maintaining a first arm parallel to a second arm when selecting the second fine height, the first arm directly pivotably connected to a bracket that is directly pivotably connected to the second arm; and permitting at least one catch member to pivot relative to the bracket during the maintaining, the at least one catch member configured for accepting a weight bar.

13. The method of claim 12, wherein the exercise device is removably attached to the attachment structure at a plurality of vertical locations along the attachment structure.

14. The method of claim 12, including biasing at least one catch member toward a retracted position.

15. The method of claim 12, wherein the first arm is vertically above the second arm.

16. A method of positioning an exercise device, comprising:

adjusting a position of at least one catch member that receives a weight bar;

during the adjusting, pivoting a first arm and a second arm together relative to at least one attachment structure mounted to a support assembly, the first arm and the second arm each directly connected to the at least one attachment structure;

during the adjusting, pivoting the first arm and the second arm together relative to at least at least one bracket, the first arm and the second arm each directly connected to the at least one bracket; and during the adjusting, pivoting the catch member relative to the bracket.

17. The method of claim 16, wherein the at least one catch member is pivotably connected to at least one of the first arm, the second arm, or the at least one bracket.

18. The method of claim 16, wherein the at least one attachment structure is mounted to a support assembly, and the adjusting comprises a vertical adjustment of the at least one catch member relative to the support assembly.

19. The method of claim 16, wherein the first arm and the second arm are vertically spaced from each other.

20. The method of claim 16, further comprising adjusting the position using a jack.

* * * * *